United States Patent [19]

Levavasseur

[11] Patent Number: 4,712,489

[45] Date of Patent: Dec. 15, 1987

[54] PROCESS FOR MARKING AND/OR DESTROYING VALUABLE DOCUMENTS IN PARTICULAR AND DEVICE FOR MAKING USE OF IT

[75] Inventor: Jean R. Levavasseur, Triel, France

[73] Assignee: Axytel, Dijon, France

[21] Appl. No.: 808,574

[22] Filed: Dec. 13, 1985

[30] Foreign Application Priority Data

Dec. 14, 1984 [FR] France ..... 84 19174

[51] Int. Cl.[4] ..... E05G 3/00; E05G 1/12

[52] U.S. Cl. ..... 109/25; 109/20; 109/33

[58] Field of Search ..... 109/20, 25, 29–34, 109/36, 37

[56] References Cited

U.S. PATENT DOCUMENTS

| | | | |
|---|---|---|---|
| 784,805 | 3/1905 | Petersen | 109/25 |
| 1,646,687 | 10/1927 | Daly | 109/25 |
| 3,654,880 | 4/1972 | Schesso | 109/25 |
| 3,797,412 | 3/1974 | DiPaola et al. | 109/29 |
| 4,236,463 | 12/1980 | Westott | 109/33 |

FOREIGN PATENT DOCUMENTS

| | | | |
|---|---|---|---|
| 1584277 | 6/1965 | Fed. Rep. of Germany . | |
| 3025853 | 1/1981 | Fed. Rep. of Germany . | |
| 8002822 | 9/1981 | France . | |
| WO83/02975 | 9/1983 | PCT Int'l Appl. | 109/25 |

*Primary Examiner*—Neill Wilson

*Attorney, Agent, or Firm*—Beveridge, DeGrandi & Weilacher

[57] ABSTRACT

The invention relates to a physicochemical process for marking and/or destroying valuable documents confined in an enclosure known as a safety enclosure for their conveyance and for their storage, and to the device for making use of it.

This invention applies to the conveyance or to the safe storage of documents whether wrapped or otherwise, whose purpose must be voided definitely in the event of theft.

6 Claims, 3 Drawing Figures

PROCESS FOR MARKING AND/OR DESTROYING VALUABLE DOCUMENTS IN PARTICULAR AND DEVICE FOR MAKING USE OF IT

The invention relates to a physicochemical process for marking or destroying, intended in particular for the defacement or legal identification of valuable documents whose nature, constitution or purpose represent a value for possible counterfeiters or illicit users, and more especially desirable documents or products such as, without implying an limitation, all the substrates, virgin or otherwise, paper money, chequebooks, identity cards, credit cards, magnetic or optical substrates, microfilms and microfiches, when these are arranged in a safety enclosure (container, suitcase, vehicle, strong room, etc.), which is equipped with any antitheft device, in bulk or in bundles or in wrapped packets.

The invention also appling to the defacement or to the destruction of archive documents which are to remain secret ot to products such as pharmaceutical drugs or dangerous materials.

Before dealing with the main provisions of the invention it is appropriate to recall the difficulties encountered when some known means of defacement or of marking are used in the same circumstances.

A number of more or less effective, and sometimes dangerous, processes have been described in various patents and are used, being intended to cause a spraying of colouring or reactive substances inside a compartment such as a suitcase, attaché case, or container fitted with an antitheft device. These procedures are completely ineffective when the products conveyed are bundled or wrapped. When combined with the triggering of a smoke generator, these methods are more dissuasive at the time, by virtue of the presumed reaction by the thief, than effective in the long term. In fact, the documents are marked nonuniformly; since the trajectory of the substances is left to chance alone, the nature of marking is not obvious, and consequently difficult to discern, frequently very scant: only the edge of the documents is stained and it is sufficient for the thief to trim them slightly in order to recover a high percentage of documents which can be used without risk; sometimes the marking is partial: it can happen that the substance reaches only some of the documents placed in the compartment and the rest are perfectly usable, making the method ineffective (chiefly where chequebooks and credit cards are involved).

In any event, when the said documents are wrapped in sheets of strong paper, plastic, or even metal foil, it becomes completely impossible to make a substance penetrate immediately between each of their faces under the effect of the triggering of an alarm.

In French Patent Application No. 78/36,292 in the name of the applicant, the indelible marking of the documents is effected by removing substance, preferably by perforation, and this means of marking consists of at least one device for firing a projectile capable of perforating all the documents of a stack confined in the container and arranged at right angles to the axis of firing.

In this embodiment, the means for marking by removal of stance with the aid of a fired projectile present a number of problems and especially that of regulating the firing power as a function of the nature and of the quantity of documents confined in the container. It has been noted that in the absence of some degree of watchfulness there was a risk that an excessively powerful ammunition could damage the wall of the container when fired and could cause an accident.

Another purely pyrotechnic device has been described in French Patent Application No. 80/02,822 in the name of the applicant, which is characterized in that it consists of means of identifying by marking, especially by removal of substance by means of a deflagrating charge consisting of a cutter cord (known per se) or of a hollow charge cartridge (known per se).

In this embodiment, the means of marking by the removal only of substance does not make it certain that the functions written in a memory on some substrates (magnetic, photographic or electronic) will be obliterated. In fact, in the case of credit cards with a magnetic strip or a microprocessor, of computer discs, of microfilms or microfiches or of banknotes, the functional part remains usable or valid even after a partial removal of substance.

To attain these objectives, the present invention relates firstly to a process characterized in that, by itself, it produces the following instantaneous operations in succession, by controlling the propagation of a shock wave: 1 - opening of any enclosure whatever of a packet of documents, 2 - partial or complete cutting of all these documents, whatever they may be, 3 - opening of a storage container over its entire length, 4 - projection of the liquid present in this storage container between each of the faces of the said documents so as to cause them to be destroyed or marked so that they are rendered unusable or legally identifiable.

It should be noted that the present invention can be applied to any means for the detection of theft or of attempted burglary, and that these methods or devices are considered to be known means in this case.

According to a characteristic of the invention, the process for defacement acts over a very short period of time, in a precise order by virtue of the direct propagation of a shock wave, first towards the front of the device, and then towards the rear, and lastly by its reflection as an echo, inside a cylindrical space.

The simultaneous combination of surprising effects which are imparted on the propagation, firstly forward and then, by reaction, backwards, of the shock wave produced by the deflagration of the explosive charge contained in a cutting cord has, in fact, been demonstrated in this invention. The first effect of the forward action is to cut the wrapping of a package along a precise line and then to cause the removal of substance from the documents inside it, together with an instantaneous vibrational phenomenon which separates all the documents from each other. During this separation, the echo of the shock wave causes, rearwards, a cutting action on a storage container in which a line of weakness has been prepared, thus defining a kind of lengthwise nozzle. The backward reflection of the shock wave at the bottom of the storage container will produce an ejection of the liquid present in this storage container through the nozzle thus formed. This liquid will be powerfully directed between each of the faces of the documents during the vibrating period, thus ensuring that they are completely marked or that they are destroyed by chemical action. This action is produced in the same manner, whatever the respective position of the documents relative to the storage container.

The invention also relates to a device which enables this process to be put to use, and which is characterized in that it comprises:

on the one hand, a transport container constructed so that it can receive any kind of documents, whether wrapped or not, so that their upper part can be maintained at approximately the same level by means of a set of wedges or of compartments whose size is predesigned for the documents which it is intended to convey;

on the other hand, a cover comprising a pyrotechnic chain consisting of an initiator, a cutting charge, an igniting device, the whole placed so that the shock wave produced by the deflagration may be directed towards the transport container, then a storage tank (made of plastic or metal) of a cylindrical shape arranged along the pryotechnic chain, in a horizontal position and comprising a lengthwise notch in the shape of an inverted V, making it possible to receive the cutting device and forming a line of weakness which, under the effect of the backward shock wave will form the nozzle through which the liquid will be ejected when the system operates;

chemical means placed in the storage container, in the form of a nonflammable and nonexplosive liquid product which makes it possible to obtain a direct and indirect effect on the documents conveyed, so as to render them unusable by obliterating their specific functions (corrupted magnetic strips, shortcircuited microprocessors, dissolved photographic gelatin) or by indelible marking (chequebooks, banknotes). The precise nature of the product placed in the storage container will need to be dictated by the composition and the nature of the documents conveyed and by the intended aim, marking or destruction.

Other characteristics and advantages of the invention will also become apparent from the reading of the following detailed description of an embodiment of the invention, which is given here by way of an example and is illustrated by the attached drawings, in which.

DETAILED DESCRIPTION

Figure 2:
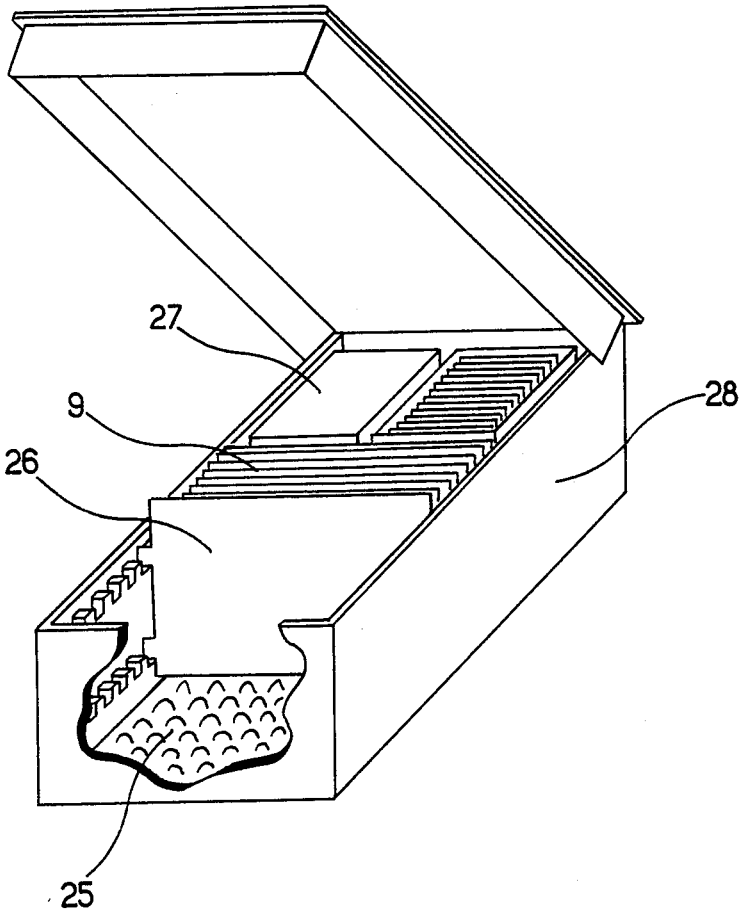
FIG. 2 is a perspective view showing the transport container and its wedging system.

In the disclosed embodiment of the apparatus, documents 9 are held in a document transport container 28 under a cover 8. The documents are held at a vertical orientation by vertical inserts 26 as shown in FIG. 2, and their upper edges are held at about the same level or elevation by the cellular foam packing material 25 on the floor of the container 28. A packet of documents is shown at 27.

The cover 8 is provided with a pair of horizontal storage containers 6 which are filled with a deleterious liquid substances 5 which is capable of destroying the documents by rendering them unusable or legally identifiable. For example, the substance may be a liquid which obliterates the documents by chemical action, or it may be a solution of penetrating solvents and dyes. Preferably the liquid in container 6 is nonflammable and nonexplosive.

Figure 1:
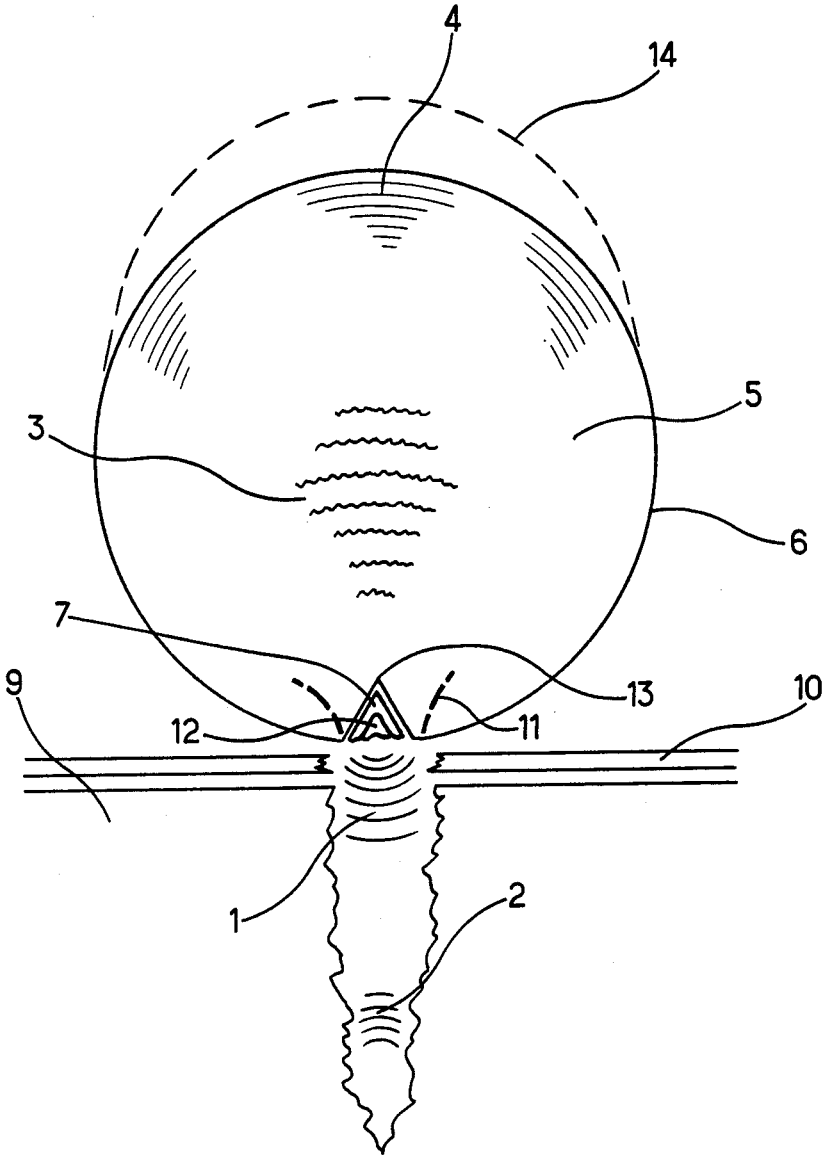
FIG. 1 shows the theoretical diagram of the propagation of the shock waves, and their corresponding effects.

As shown in FIG. 1, the lower wall of a container 6, has a V-shaped recess which forms a rupturable line of weakness. Nested in this recess, there is a horizontal rectilinear hollow charge 7 which is shrouded in metal and is located to produce a downwardly directed shock wave. A cutting cord 12 is positioned on the lower side of the charge 7 where the energy of detonation will propel the cord into the documents, thereby cutting them to increase their receptivity to the deleterious liquid 5. Preferably, the distance between the charge 7 and the documents 9 is no more than about 5 mm.

Because the charge 7 lies between the vessel 6 and the document 9 at the time of detonation, the energy of detonation acts in one direction toward the vessel and in an opposite direction toward the documents.

To detonate the pyrotechnic charge, the cover 8 is provided with an initiator 15 and a firing device 16 which are connected to the charge 7.

Figure 3:
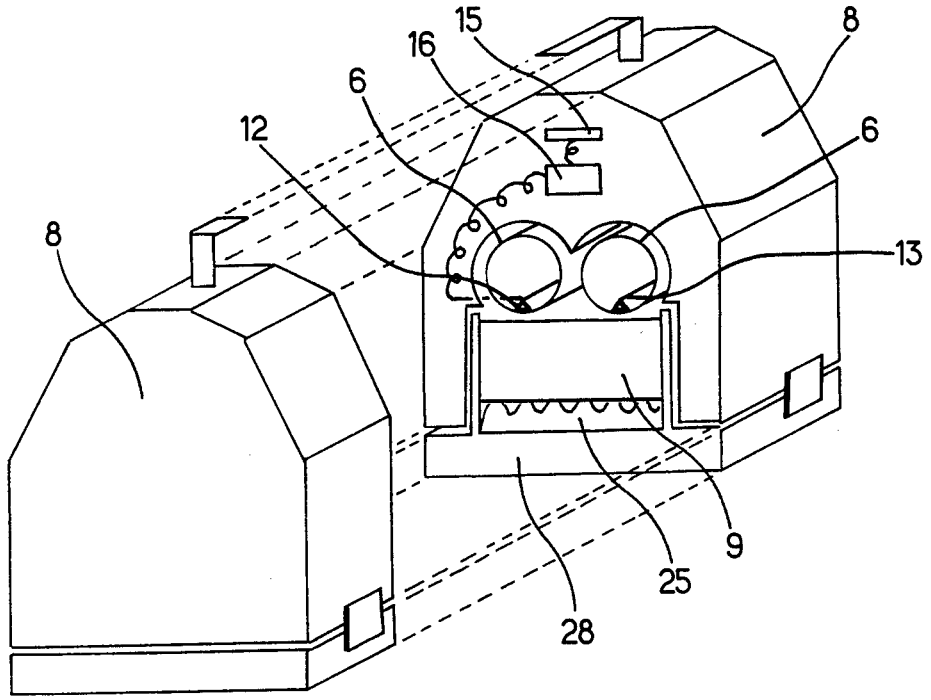
FIG. 3 is a perspective view of an embodiment of the cover comprising its pyrotechnic chain and its storage containers for chemical products.

In the embodiment shown in FIGS. 1 to 3 it can be appreciated better that the apparently simultaneous phenomena actually take place in a perfectly established chronological order. In fact, when an attempt is made to burgle a safety container, an alarm is triggered and causes the ignition of the firing device. This leads to the deflagration of the cutting cord (12) whose shock wave (1) fulfills its first role by opening the enclosure (10) of the packet and then penetrating into the documents (9), thus producing a fairly deep tear in each of the documents. At the same time, an echo (2) of this shock wave is formed, projecting the metal enclosure of the hollow charge (7) backwards so as to open the storage container (6) along the line of weakness (13). In this way, the echo (2) enters the interior of the storage container (6) and causes an imbalance in the physical structure of the liquid (5), which is then ejected through the opening (11) by the joint action of the vibrational phenomenon (3), the reflection (4) at the bottom of the storage container and the distortion of the storage container walls (14), which exert an additional pressure on its contents (5).

Provision can also be made for cutting charges of different powers which will cause greater destruction, whose effects can be readily calculated in order to provide the essential protection.

Naturally, the invention is not limited to the embodiment described above and depicted, other alternative forms whereof can be provided without departing thereby from the scope of the attached claims.

I claim:

1. Apparatus for marking and/or destroying valuable documents contained in an enclosure, comprising:

(a) a vessel containing a deleterious substance means for damaging the documents to render them unusable or legally identifiable;

(b) a pyrotechnic charge means located and detonated at a position which lies between the documents and the vessel so that energy from the pyrotechnic charge is released in one direction toward the vessel and in an opposite direction toward the documents, to cut the documents and increase their receptivity to said deleterious substance means;

(c) said vessel having an outlet opening means for releasing the substance into the documents to render the documents unusuable or legally identifiable, said outlet opening means being openable by cutting in response to energy from the detonation of said pyrotechnic charge.

2. Apparatus according to claim 1 wherein the vessel has a line of weakness which ruptures in said one direction to form said outlet opening when the pyrotechnic charge is detonated.

3. Apparatus according to claim 2 including a cover which is provided with a pyrotechnic chain which includes an initiator, a firing device for said pyrotechnic charge, said pyrotechnic charge being a rectilinear hollow charge with a shroud which is located to prodice a downwardly directed shock wave, said vessel extending horizontally along the pyrotechnic charge and having a V-shaped recess formed therein, said pyrotechnic charge lying in said V-shaped recess, said V-shaped recess comprising means for providing a line of weakness which ruptures to form a substance outlet opening when it is subjected to the energy of detonation of said pryotechnic charge.

4. Apparatus for marking and/or destroying valuable documents contained in an enclosure, comprising:

(a) a vessel containing a deleterious substance means for damaging the documents to render them unusable or legally identifiable;

(b) a pyrotechnic charge means for cutting the documents and increase their receptivity to said deleterious substance means;

(c) said vessel having an outlet opening means for releasing the substance into the documents to render the documents unusable or legally identifiable, said outlet opening means being openable by cutting in response to energy from the detonation of said pyrotechnic charge, (d) said apparatus including a cover which is provided with a pyrotechnic chain which includes an initiator, a firing device for said pyrotechnic charge, said pyrotechnic charge being a rectilinear hollow charge with a shroud which is located to prodice a downwardly directed shock wave, said vessel extending horizontally along the pyrotechnic charge and having a V-shaped recess formed therein, said pyrotechnic charge lying in said V-shaped recess, said V-shaped recess comprising means for providing a line of weakness which ruptures to form a substance outlet opening when it is subjected to the energy of detonation of said pyrotechnic charge.

5. A process for marking and/or destroying valuable documents contained in an enclosure, said process comprising the following steps:

(a) detonating a pyrotechnic charge which lies between the said documents and a vessel containing a deleterious substance means for damaging the documents to render them unusable or legally identifiable, so that energy from the pyrotechnic charge is released in one direction toward the vessel and in an opposite direction toward the documents;

(b) in response to said detonation step, cutting the documents to increase their receptivity to said deleterious substance means;

(c) cutting an outlet opening in said vessel in response to said detonation step, and releasing the deleterious substance means from said outlet opening into the documents to render the documents unususable or legally identifiable.

6. A process according to claim 5 wherein the vessel has a line of weakness which ruptures in said one direction to form said outlet opening when the pyrotechnic charge is detonated.

* * * * *